US006306814B1

(12) United States Patent
Appel et al.

(10) Patent No.: US 6,306,814 B1
(45) Date of Patent: Oct. 23, 2001

(54) DETERGENT COMPOSITIONS

(75) Inventors: Peter William Appel; Jelles Vincent Boskamp; Christophe Michel Joyeux; Marcel van der Kraan; Henning Wagner, all of Vlaardingen (NL)

(73) Assignee: Unilever Home & Personal Care, USA, Greenwich, CT (US)

( * ) Notice: Subject to any disclaimer, the term of this patent is extended or adjusted under 35 U.S.C. 154(b) by 0 days.

(21) Appl. No.: 09/484,069

(22) Filed: Jan. 18, 2000

(30) Foreign Application Priority Data

Jan. 26, 1999 (GB) ..... 9901688

(51) Int. Cl.[7] ..... C11D 17/00
(52) U.S. Cl. ..... 510/446; 510/224; 510/298
(58) Field of Search ..... 510/224, 294, 510/298, 446

(56) References Cited

U.S. PATENT DOCUMENTS

| | | | | |
|---|---|---|---|---|
| 4,460,490 | * | 7/1984 | Barford et al. | 510/191 |
| 4,767,559 | | 8/1988 | Kruse et al. | 252/106 |
| 5,580,392 | | 12/1996 | Sulc et al. | 134/7 |
| 5,759,974 | | 6/1998 | Menke | 510/191 |

FOREIGN PATENT DOCUMENTS

| | | | |
|---|---|---|---|
| 29618136 | * | 12/1996 | (DE) . |
| 298 23 505 | | 6/1999 | (DE) . |
| 298 23 506 | | 6/1999 | (DE) . |
| 299 11 485 | | 11/1999 | (DE) . |
| 299 11 486 | | 11/1999 | (DE) . |
| 299 11 487 | | 11/1999 | (DE) . |
| 298 23 942 | | 1/2000 | (DE) . |
| 0 481 793 | | 4/1992 | (EP) . |
| 711 827 | | 5/1996 | (EP) . |
| 0 779 807 | | 6/1997 | (EP) . |
| 0 896 053 | | 2/1999 | (EP) . |
| 2458582 | | 2/1981 | (FR) . |
| 2545499 | | 11/1984 | (FR) . |
| 2570079 | | 3/1986 | (FR) . |
| 2695134 | | 3/1994 | (FR) . |
| 911204 | | 11/1962 | (GB) . |
| 1307387 | * | 2/1973 | (GB) . |
| 62225600 | * | 10/1987 | (JP) . |
| 97/03177 | | 1/1997 | (WO) . |
| 98/24873 | | 6/1998 | (WO) . |
| 98/30208 | * | 7/1998 | (WO) . |
| 98/42817 | | 10/1998 | (WO) . |
| 98/46719 | | 10/1998 | (WO) . |
| 98/55590 | | 12/1998 | (WO) . |
| 99/06522 | | 2/1999 | (WO) . |
| 99/27068 | | 6/1999 | (WO) . |
| 99/37746 | | 7/1999 | (WO) . |
| 99/40172 | | 8/1999 | (WO) . |
| 99/55823 | | 11/1999 | (WO) . |

OTHER PUBLICATIONS

Derwent Abstract of DE 299 11 485—Nov. 25, 1999.
Derwent Abstract of DE 299 11 487—Nov. 25, 1999.
DM/044,197, International Designs Bulletin, Jun. 2, 1998.
DM/044,927, International Designs Bulletin, Aug. 21, 1998.
Dessins et modeles publies, BOPI 98/20, pp. 351–356, Oct. 2, 1998.

(List continued on next page.)

*Primary Examiner*—Lorna M. Douyon
(74) *Attorney, Agent, or Firm*—Rimma Mitelman

(57) ABSTRACT

A detergent tablet of compacted particulate composition which has a pair of opposite faces spaced apart from each other and joined by a peripheral surface of the tablet, wherein the tablet has a first region which provides a first part of a said face and a second region which provides an adjoining part of the face with a discontinuity at the junction of the said parts of the face; and apparatus adapted to make such a tablet.

7 Claims, 7 Drawing Sheets

OTHER PUBLICATIONS

Figure 1A:
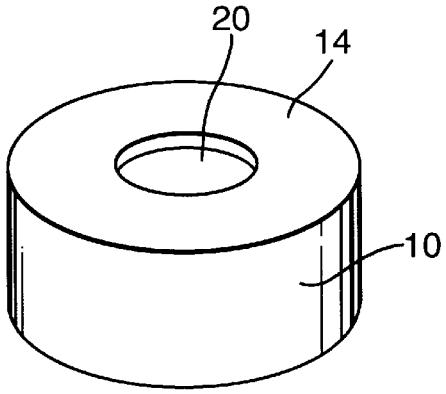

Boletin Official De La Propiedad Industrial, #142828, pp. 3080–3081, Aug. 1, 1998.
Unilever Community Trade Mark application, Mar. 5, 1998, reference #CTM/RA/5MB/TAB1/001.
Derwent abstract of EP 0 779 807, Jun. 25, 1997.
Derwent abstract of WO 97/03177, Jan. 30, 1997.
Derwent abstract of FR 2695134, Mar. 4, 1994.
Derwent abstract of FR 25700079, Mar. 14, 1986.
Derwent abstract of FR 2545499, Nov. 9, 1984.
Derwent abstract of FR 2458582, Feb. 6, 1981.
Derwent abstract of DE 298 23 505, Jun. 17, 1999.
Derwent abstract of DE 298 23 506, Jun. 17, 1999.
Derwent abstract of DE 299 11 486, Nov. 18, 1999.
Derwent abstract of DE 298 23 942, Jan. 20, 2000.

* cited by examiner 32
30
36
42

50
36
42

40
34
50
30
36
42

34
36
42

12
12
36
42

12
54
36

34
30
36

40
36
42

12
18
12
36
42

18
12
30
36
42

DETERGENT COMPOSITIONS

The present invention is concerned with detergent compositions in the form of tablets. These tablets may be for the purpose of fabric washing in a laundry washing machine, for dish washing in a mechanical dish washer or for some other cleaning function.

Tablets of detergent composition may be "homogenous" tablets in which the entire tablet consists of a single composition compacted into tablet form. However the present invention is concerned with "heterogenous tablets" in which the tablet is subdivided into more than one separate region and normally is made from more than one composition. Tablets which are "heterogenous" in that they are subdivided into two layers have been marketed commercially.

When tablets are formed by compaction of a particulate composition they are generally made by urging two punches towards each other within a surrounding mould—or possibly one punch is driven into a closed mould.

The resulting tablet has a pair of end faces spaced apart from each other and a peripheral surface which may be cylindrical. If the tablet has two layers, each end face will be formed by one layer and the periphery will be provided partly by one layer and partly by the other.

When making a tablet with two layers, an appropriate procedure is to put the composition for one layer into a mould, lightly compact it, then add the composition for the second layer and compact the entire contents of the mould at a greater pressure which further compacts the first layer as well as compacting the second layer and joining the two layers together.

As well as tablets which are subdivided into two layers, other configurations for subdivision of the tablet into more than one region have also been envisaged and are mentioned in GB-A-911204 for instance. Tablets in which a central core region lies at the same level as the surrounding part of one end face of the tablet have been shown in Registered Design applications. The manufacture of such tablets was not disclosed but would presumably use a single punch to shape the end face and would require subjecting the entire tablet to a compaction step with greater pressure than used in any intermediate compaction step.

Broadly, aspects of the present invention reside in the provision of tablets wherein each tablet has a pair of opposite faces spaced apart from each other and joined by a peripheral surface of the tablet, wherein the tablet is subdivided into at least two regions which are each visible at a said face, wherein there are distinctive features and/or properties which can be achieved through separate compaction of the regions.

In a first aspect, the present invention provides a detergent tablet of compacted particulate composition which has a pair of opposite faces spaced apart from each other and joined by a peripheral surface of the tablet, wherein the tablet has a first region which provides a first part of a said face and a second region which provides an adjoining part of the face with a discontinuity such as a step or groove at the junction of the said parts of the face.

Preferably the arrangement is such that the first part of the face is not at the same level as the adjacent part, so that there is a step at the junction of the two parts. Even if the two parts are at substantially the same level there is likely to be a groove, a slight step or a line in the surface at their junction.

The first part may stand out from the adjacent part of the end face or it may be inset from the adjacent part of the end face.

Preferably the first region is a core which is entirely surrounded by another region of the tablet. A single such surrounding region may provide the entire peripheral surface of the tablet and the remainder of the tablet end faces. Other arrangements are conceivable. A first region might for instance extend to the tablet periphery and form a portion of the peripheral surface. A region surrounding a core might possibly be split into two layers, and a core could itself have two layers.

In a preferred arrangement the first region extends through the tablet so as to be visible at both faces, but is inset from the surrounding part of each face. Another possibility is that such a region could be visible as part of one face yet extend only part way through the tablet, so that subdivision into regions would not be visible at the opposite face of the tablet.

The regions of the tablet will usually be of different composition or different physical properties or both.

In a second aspect, this invention provides a process for producing a detergent tablet which has a pair of opposite faces spaced apart from each other and joined by a peripheral surface of the tablet, wherein the tablet has at least two discrete regions visible at a said face, comprising steps of:

introducing a particulate composition into a mould cavity around a plunger which projects into or through the cavity, followed by driving at least one punch onto the composition around the plunger in the cavity, thereby compacting it into one region of the tablet withdrawing the plunger from within the compacted composition, introducing a second particulate composition into the space vacated by the plunger, and urging at least one plunger against the composition introduced into this space, so as to compact it into another region of the tablet.

There is no need to apply any substantial compaction pressure to the first composition when compacting the second, thus allowing the compaction pressure applied to each of the two regions of the tablet to be chosen independently. However, some light pressure may be applied to the (already compacted) first composition to hold it steady while the second composition is compacted.

Preferably the process is carried out using a pair of punches which are relatively movable towards each other within the mould cavity and away from each other, wherein each punch encloses or at least partially surrounds a plunger movable axially relative to the punch. During the first compaction step one or both punches may move. During the second compaction step one or both plungers may move.

Conveniently, the first particulate composition would be delivered into the mould cavity above one punch while the plunger associated with that punch project upwardly from it so as to be surrounded by the particulate composition.

Compaction of the first particulate composition would then be carried out by urging the two punches relatively towards each other, although one may remain stationary relative to the mould cavity if desired. Compaction of the second particulate composition would be carried out by urging the two plungers relatively towards each other, although again one may be driven towards the other which remains immobile.

Such a process is preferably carried out using a rotary tableting press in which a rotary table defines a plurality of mould cavities and in which a pair of punches each with a respective axially movable plunger is associated with each mould cavity.

An advantage of the process of this invention is that the core region and surrounding region of the tablet can both be compacted from powder compositions within a single mould cavity. There is no necessity to prefabricate a core region in one mould cavity and somehow position it within another mould cavity. A further advantage is that the tableting pressures applied to each of the compositions can be chosen independently.

The process may lead to tablets in which the compacted second composition provides a part of at least one tablet face which is inset from an adjacent or surrounding part of the tablet face provided by the first composition.

Recessing the exposed area of a region can be advantageous in itself. At the time of use, tablets may be placed in a washing machine together with fabrics with the result that the fabrics may come into direct contact with the tablet before it disintegrates in the wash water. Recessing the exposed area of a tablet region will reduce the opportunity for direct contact between fabrics and the exposed surface of that region (especially if that region is a central core) making it possible to incorporate into that recessed (ie inset) region ingredients such as bleach which desirably should not come into direct contact with fabrics before they have—at least to a substantial extent—dispersed in the wash liquor.

Thus in one form of this invention the inset region contains bleach or bleach activator at a greater concentration than in a surrounding region of the tablet.

Subdividing such a tablet into discrete regions in such a way that individual regions can be compacted at different compaction pressures creates a number of possibilities for tablet formulation. Some of these are further aspects of the present invention as will be explained below.

One possibility concerns the compromise between strength and speed of disintegration of tablets. When making tablets by compaction of a particulate composition there is an inherent conflict between a desire for tablets which are mechanically strong during transport and handling prior to use and a desire that tablets should disintegrate quickly when brought into contact with wash liquor. Increasing the compaction force increases mechanical strength but also increases the time for tablet disintegration.

In an aspect of the present invention a tablet which has a pair of opposite faces spaced apart from each other and joined by a peripheral surface of the tablet also has at least one region visible at a face of the tablet and providing less than half the area of that face, further characterised in that the said region has a mechanical strength which differs from, and preferably is less than, that of the surrounding region (and hence the tablet as a whole). The adjoining/surrounding larger region of the tablet will then provide mechanical protection for the more fragile region during storage and transport of the tablet prior to use. This region of the tablet is preferably a core, encircled by the larger region. It may disintegrate rapidly on contact with wash water at the time of use, commensurate with its lesser mechanical strength.

The said region which provides less than half the area of a tablet face may be characterised by a higher porosity (content of air by volume) than the adjoining/surrounding region, as well as or alternatively to, the characteristic of less strength. It may also, or alternatively, be characterised by lower hardness than the surrounding region.

The porosity of a tablet region in inversely related to its density and is conveniently expressed as the percentage of its volume which is air (i.e. empty space).

The air content of a tablet region can be calculated from the volume and weight of the tablet region, provided the true density of the solid content is known. The latter can be measured by compressing a sample of the material under vacuum with a very high applied force, then measuring the weight and volume of the resulting solid object.

In a related aspect, this invention provides a process of making a tablet which has a pair of opposite faces spaced apart from each other and joined by a peripheral surface, which tablet has at least two discrete regions each of which provides only part of a face of the tablet further characterised in that the maximum pressure applied to the one region to compact it is different from the maximum pressure applied to another region to compact it.

If the regions are a core region and a surrounding region which provides the peripheral surface of the tablet, the pressure applied to the core region may be less than the pressure applied to the surrounding region.

The mechanical strength of the whole tablet may be denoted as the diametral fracture stress derived from the measurement of force at failure as described in our published application WO098/42817. The corresponding properties of the core may be measured by measuring the properties of smaller tablets compacted solely from the second composition in a smaller mould and with the appropriate force such that these test tablets have the same size as the core region of a tablet and have been subjected to the same compaction pressure.

An alternative test for the relative strength of two regions of the tablet is to compact each of the compositions separately into homogenous test tablets, of identical size (which may be the same as the external dimensions of the outer region) using the same compaction pressures as used when making the heterogenous tablets of the invention. The strengths of the test tablets are then compared, e.g. by means of a compression test.

Constructing a tablet with plurality of separate regions and the possibility of compacting them at different pressures facilitates arranging for ingredients in one region of the tablet to be released into the wash liquor before ingredients in the other region of the tablet.

It may be arranged that a core region is compacted at light pressure, so as to disintegrate quickly.

On the other hand, a core region will have only a very small surface area exposed to the wash water and consequently it may be arranged that such a core region disintegrates more slowly when the tablet is brought into contact with wash water, thus utilising the core region to give delayed release of an ingredient into the wash liquor. Slower disintegration of the core could also be promoted by compacting it at higher pressure.

Further aspects of the present invention concern compositions used to make regions of the tablet.

An aspect of this invention provides a tablet which has a pair of opposite faces spaced apart from each other and joined by a peripheral surface of the tablet and has at least one region such as a core which provides only part of a face of the tablet, wherein the said region of the tablet contains a material which swells when in contact with water, such material being present at a greater concentration in the said region than in the adjoining or surrounding region. When the tablet comes into contact with wash water, swelling of this material in the said region will promote disintegration of that region and also apply force to the surrounding or adjoining region, thus increasing the disintegrating efficacy of the swelling material.

Whichever region of the tablet dissolves more slowly may incorporate a fabric softening agent, such as softening clay. It is known to incorporate a fabric softening clay in washing powder so as to provide a softening action on the fabrics at the same time that they are washed (so called "softening in the wash"). As we have already acknowledged in an unpublished UK application, it is desirable that fabric softening agent is liberated into a wash liquor somewhat later than the detergent and other ingredients. This can be implemented by a tablet of the present invention, putting the fabric softening agent such as clay in a region which disintegrates more slowly than another region and may have greater mechanical strength.

Thus an aspect of this invention provides a tablet which has a pair of opposite faces spaced apart from each other and joined by a peripheral surface of the tablet, which tablet has at least two discrete regions each of which provides only part of a said face of the tablet, wherein one of said regions of the tablet contains a fabric softening agent at a greater concentration than the other region.

The segregation of bleach activator from other tablet constituents, either peroxygen bleach or materials which are sensitive to oxidation, has been recognised as a desirable possibility. It has been difficult to achieve in tablet manufacture, but it can be achieved by means of the present invention because of the possibility of compacting the compositions of the core region and surrounding region with different compaction pressures.

Thus an aspect of this invention provides a tablet which has a pair of opposite faces spaced apart from each other and joined by a peripheral surface of the tablet, which tablet has at least two discrete regions each of which provides only part of a said face of the tablet wherein one region of the tablet contains bleach activator at a greater concentration than the other.

It may be desirable to liberate enzymes into the wash liquor before the liberation of bleach or bleach activator. So, an aspect of this invention provides a tablet which has a pair of opposite faces spaced apart from each other and joined by a peripheral surface of the tablet, which tablet has at least two discrete regions each of which provides only part of a said face of the tablet wherein one region of the tablet contains an enzyme or enzymes at a greater concentration than the other region, while if a bleach system is present, the said other region preferably contains bleach and/or bleach activator at a greater concentration than the region with the greater concentration of enzyme(s).

Yet another aspect of this invention provides a tablet which has a pair of opposite faces spaced apart from each other and joined by a peripheral surface of the tablet, which tablet has at least two discrete regions each of which provides only part of a said face of the tablet wherein one region of the tablet generates a different pH on dissolution than the composition of the other region. When such a tablet is used the pH of the resulting wash liquor will be determined by the composition of the whole tablet. However, while it is in the course of disintegration and dissolution the pH within and close to each region will be primarily determined by the composition of that region. This can be put to use. Notably a region which contains bleach activator may be formulated to give a more acidic pH than the other region (and the tablet as a whole). This transiently more acidic pH will promote the reaction of bleach activator to generate peracid while the tablet is disintegrating and dissolving.

It will be apparent from the above that some aspects of this invention have been defined without stating that a region which provides only part of an end face of a tablet is inset or otherwise distinguished from a surrounding region of the tablet by a discontinuity in the surface of the tablet. This feature may be present however, and may be preferred.

Constituent Materials

A number of materials which may be utilised to make regions of tablets will now be discussed.

Organic Surfactant

Tablets of this invention will generally contain organic surfactant. This will come from one or more of the categories of surfactant used in detergent compositions for fabric washing. These are most usually anionic and nonionic surfactants and mixtures of the two. Amphoteric (including zwitterionic) and less commonly cationic detergents can also be used.

Anionic Surfactant Compounds

Synthetic (i.e. non-soap) anionic surfactants are well known to those skilled in the art. The anionic surfactant may comprise, wholly or predominantly, linear alkyl benzene

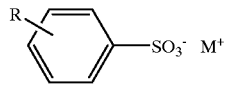

where R is linear alkyl of 8 to 15 carbon atoms and $M^+$ is a solubilising cation, especially sodium.

Primary alkyl sulphate having the formula $$ROSO_3^-M^+$$

in which R is an alkyl or alkenyl chain of 8 to 18 carbon atoms especially 10 to 14 carbon atoms and $M^+$ is a solubilising cation, is also commercially significant as an anionic surfactant and may be used in this invention.

Frequently, such linear alkyl benzene sulphonate or primary alkyl sulphate of the formula above, or a mixture thereof will be the desired non-soap anionic surfactant and may provide 75 to 100 wt % of any anionic non-soap surfactant in the composition.

Examples of other non-soap anionic surfactants include olefin sulphonates; alkane sulphonates; dialkyl sulphosuccinates; and fatty acid ester sulphonates.

One or more soaps of fatty acids may also be included in addition to non-soap anionic surfactant. Examples are sodium soaps derived from the fatty acids from coconut oil, beef tallow, sunflower or hardened rapeseed oil.

Nonionic Surfactant Compounds

Nonionic surfactant compounds include in particular the reaction products of compounds having a hydrophobic group and a reactive hydrogen atom, for example, aliphatic alcohols, acids, amides or alkyl phenols with alkylene oxides, especially ethylene oxide.

Specific nonionic surfactant compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

Especially preferred are the primary and secondary alcohol ethoxylates, especially the $C_{9-11}$ and $C_{12-15}$ primary and secondary alcohols ethoxylated with an average of from 3 to 20 moles of ethylene oxide per mole of alcohol.

Amphoteric Surfactants

Amphoteric surfactants which may be used jointly with anionic or nonionic surfactants or both include amphopropionates of the formula:

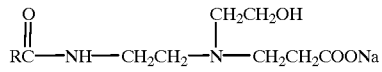

where RCO is a acyl group of 8 to 18 carbon atoms, especially coconut acyl.

The category of amphoteric surfactants also includes amine oxides and also zwitterionic surfactants, notably betaines of the general formula

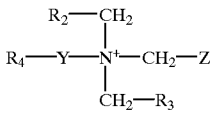

where $R_4$ is an aliphatic hydrocarbon chain which contains 7 to 17 carbon atoms, $R_2$ and $R_3$ are independently hydrogen, alkyl of 1 to 4 carbon atoms or hydroxyalkyl of 1 to 4 carbon atoms such as $CH_2OH$, Y is $CH_2$ or of the form $CONHCH_2CH_2CH_2$(amidopropyl betaine);

Z is either a $COO^-$(carboxybetaine), or of the form $CHOHCH_2SO_3$—(sulfobetaine or hydroxy sultaine).

Another example of amphoteric surfactant is amine oxide of the formula

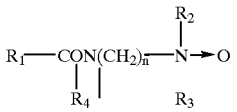

where $R_1$ is $C_{10}$ to $C_{20}$ alkyl or alkenyl $R_2$, $R_3$ and $R_4$ are each hydrogen or $C_1$ to $C_4$ alkyl while n is from 1 to 5.

Detergency Builder

Tablets of this invention will generally include a water-soluble or water-insoluble detergency builder or a mixture of the two.

Water-soluble phosphorus-containing inorganic detergency builders include the sodium and potassium orthophosphates, metaphosphates, pyrophosphates and polyphosphates.

Alkali metal aluminosilicates are strongly favoured as environmentally acceptable water-insoluble builders for fabric washing. Alkali metal (preferably sodium) aluminosilicates may be either crystalline or amorphous or mixtures thereof, having the general formula:

$$0.8\text{–}1.5\ Na_2O.Al_2O_3.0.8\text{–}6\ SiO_2.xH_2O$$

These materials contain some bound water (indicated as "xH2O") and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1429143 (Procter & Gamble). The preferred sodium aluminosilicates of this type are the well known commercially available zeolites A and X, the zeolite P described and claimed in EP 384070 (Unilever) which is also referred to as zeolite MAP and mixtures thereof. Zeolite MAP is available from Crosfields under their designation Zeolite A24.

Conceivably, water-insoluble detergency builder could be a crystalline layered sodium silicate as described in U.S. Pat. No. 4,664,839.

NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3,417,649 and DE-A-3,742,043. Other such layered silicates, which can be used have the general formula $NaMSi_xO_{2x+1}.yH_2O$ wherein M is sodium or hydrogen, x is a number from 1.9 to 4, preferably 2, and y is a number from 0 to 20, preferably 0.

Crystalline layered silicate may be used in the form of granules which also contain citric acid.

Non-phosphorous water-soluble builders may be organic or inorganic. Inorganic builders that may be present include alkali metal (generally sodium) carbonate; while organic builders include polycarboxylate polymers, such as polyacrylates and acrylic/maleic copolymers, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates.

Alkali metal silicate, particularly sodium ortho-, meta- or disilicate has detergency building properties and may be used in substantial quantity in tablets for machine dishwashing. It is desirably included in smaller quantities in tablets for fabric washing. The presence of such alkali metal silicates may be advantageous in providing protection against the corrosion of metal parts in washing machines, besides providing some detergency building.

Tablet compositions preferably include polycarboxylate polymers, more especially polyacrylates and acrylic/maleic copolymers which can function as builders and also inhibit unwanted deposition onto fabric from the wash liquor.

If a composition is formulated to have low phosphate, the amount of inorganic phosphate builder may be less than 5 wt % of the tablet composition.

Bleach System

Detergent tablets according to the invention may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the tablet.

Preferred inorganic persalts are sodium perborate monohydrate and tetrahydrate, and sodium percarbonate.

Bleach activators have been widely disclosed in the art. Preferred examples include peracetic acid precursors, for example tetraacetylethylene diamine (TAED), and perbenzoic acid precursors. The quaternary ammonium and phosphonium bleach activators disclosed in U.S. Pat. Nos. 4,751,015 and 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

Bleach activator is usually present in an amount from 1 to 10% by weight of the tablet, possibly less in the case of a transition metal catalyst which may be used as 0.1% or more by weight of the tablet.

Disintegrants

As indicated above a tablet of this invention may include a material which functions as a disintegrant. Such a material may be such as to swell on contact with water, thus subjecting the compacted tablet composition to internal pressure.

A number of materials are known for use as swelling disintegrants in pharmaceutical tablets and these may be used in detergent tablets of this invention. Examples include organic materials such as starches, for example, corn, maize, rice and potato starches and starch derivatives, such as Primojel (Trade Mark) carboxymethyl starch and Explotab (Trade Mark) sodium starch glycolate; celluloses and cellulose derivatives, for example, Courlose (Trade Mark) and Nymcel (Trade Mark) sodium carboxymethyl cellulose, Ac-di-Sol (Trade Mark) cross-linked modified cellulose, and Hanfloc (Trade Mark) microcrystalline cellulosic fibres; and various synthetic organic polymers, notably cross-linked polvinyl pyrrolidone, for example, Polyplasdone (Trade Mark) Xl or Kollidon (Trade Mark) CL. Inorganic swelling disintegrants include bentonite clay.

It is possible to include a combination of an acid and a carbonate, which reacts to liberate carbon dioxide when in contact with water. Such a combination is a chemical or effervescent disintegrant. Notably sodium carbonate or bicarbonate may be used together with citric or tartatic acid.

Polymer Binder

Tablets of this invention may include an organic water-soluble polymer, serving as a binder when the particles are compacted into tablets. This polymer may be a polycarboxylate included as a supplementary builder, as mentioned earlier. It may be applied as a coating to some or all of the constituent particles prior to compaction.

As taught in our EP-A-522766, such polymers can function to enhance tablet disintegration at the time of use, as well as acting as a binder to enhance tablet strength prior to use.

It is preferred that such a binder material, if present, should melt at a temperature of at least 35° C., better at 40° C or above, which is above ambient temperatures in many temperate countries. For use in hotter countries it will be preferred that the melting temperature is somewhat above 40° C., so as to be above the ambient temperature.

For convenience the melting temperature of the binder material should be below 80° C.

Preferred binder materials are synthetic organic polymers of appropriate melting temperature, especially polyethylene glycol. Polyethylene glycol of average molecular weight 1500 (PEG 1500) melts at 45° C. and has proved suitable. Polyethylene glycol of higher molecular weight, notably 4000 or 6000, can also be found.

Other possibilities are polyvinylpyrrolidone, and polyacrylates and water-soluble acrylate copolymers.

The binder may suitably be applied to the particles by spraying, e.g. so as a solution or dispersion. It may be applied to particles which contain organic surfactant. If used, the binder is preferably used in an amount within the range from 0.1 to 10% by weight of the tablet composition, more preferably the amount is at least 1% or even at least 3% by weight of the tablets. Preferably the amount is not over 8% or even 6% by weight unless the binder serves some other additional function.

Water-soluble Disintegrants

Published patent applications have revealed that certain water-soluble materials function to promote tablet disintegration at the time of use and such materials may be used in tablets of this invention so as an alternative to, or in addition to, and insoluble but water-swellable disintegrant.

Such materials include compounds of high water-solubility, a specified form of sodium tripolyphosphate and combinations of these two. Such material may be present as at least 10 or 15% of the composition of a tablet or region thereof, possibly at least 25% up to 50 or 60%, possibly more.

Highly water soluble materials, which are one of the two possibilities are compounds, especially salts, with a solubility at 20° C. of at least 50 gms per 100 gms of water. Such materials have been mentioned in our published patent applications including EP-A-711827 and EP-A-838519. A solubility of at least 50 grams per 100 grams of water at 20° C. is an exceptionally high solubility: many materials which are classified so as water soluble are less soluble than this.

Some highly water-soluble materials which may be used are listed below, with their solubilities expressed so as grams of solid to form a saturated solution in 100 grams of water at 20° C.:

| Material | Water Solubility (g/100 g) |
|---|---|
| Sodium citrate dihydrate | 72 |
| Potassium carbonate | 112 |
| Urea | >100 |
| Sodium acetate, anhydrous | 119 |
| Sodium acetate, trihydrate | 76 |
| Magnesium sulphate $7H_2O$ | 71 |
| Potassium acetate | >200 |

By contrast the solubilities of some other common materials at 20° C. are:

| Material | Water Solubility (g/100 g) |
|---|---|
| Sodium chloride | 36 |
| Sodium sulphate decahydrate | 21.5 |
| Sodium carbonate anhydrous | 8.0 |
| Sodium percarbonate anhydrous | 12 |
| Sodium perborate anhydrous | 3.7 |
| Sodium tripolyphosphate anhydrous | 15 |

Preferably this highly water soluble material is incorporated so as particles of the material in a substantially pure form (i.e. each such particle contains over 95% by weight of the material). However, the said particles may contain material of such solubility in a mixture with other material, provided that material of the specified solubility provides at least 50% by weight of these particles, better at least 80%.

A particularly preferred material, sodium acetate trihydrate, is normally produced by a crystallisation process, so that the crystallised product contains 3 molecules of water of crystallisation for each sodium and acetate ion pair. Sodium acetate in an incompletely hydrated form, which may be produced by a spray-drying route, can also be used.

Another possibility is that the said particles which promote disintegration are particles containing sodium tripolyphosphate with more than 50% of it (by weight of the particles) in the anhydrous phase I form. Such particles may contain at least 80% by weight tripolyphosphate and possibly at least 95%. Detergent tablets containing such material are the subject of our EP-A-839906.

Sodium tripolyphosphate is very well known so as a sequestering builder in detergent compositions. It exists in a hydrated form and two crystalline anhydrous forms. These are the normal crystalline anhydrous form, known so as phase II which is the low temperature form, and phase I which is stable at high temperature. The conversion of phase II to phase I proceeds fairly rapidly on heating above the transition temperature, which is about 420° C., but the reverse reaction is slow. Consequently phase I sodium tripolyphosphate is metastable at ambient temperature.

A process for the manufacture of particles containing a high proportion of the phase I form of sodium tripolyphosphate by spray drying below 420° C. is given in U.S. Pat. No. 4,536,377.

Particles which contain this phase I form will often contain the phase I form of sodium tripolyphosphate so as at least 55% by weight of the tripolyphosphate in the particles. Other forms of sodium tripolyphosphate will usually be present to a lesser extent. Other salts may be included in the particles, although that is not preferred.

Desirably, this sodium tripolyphosphate is partially hydrated. The extent of hydration should be at least 1% by weight of the sodium tripolyphosphate in the particles. It may lie in a range from 2.5 to 4%, or it may be higher, e.g. up to 8%.

Suitable material is commercially available. Suppliers include Rhone-Poulenc, France and Albright & Wilson, UK.

"Rhodiaphos HPA 3.5" from Rhone-Poulenc has been found particularly suitable. It is a characteristic of this grade of sodium tripolyphosphate that it hydrates very rapidly in a standard Olten test. We have found that it hydrates so as quickly so as anhydrous sodium tripolyphosphate, yet the prehydration appears to be beneficial in avoiding unwanted crystallisation of the hexahydrate when the material comes into contact with water at the time of use.

Fabric Softening Agents

A tablet may incorporate one or more fabric softening agents, preferably in a region which is slower to disintegrate, so that the softening agent is released later in the wash cycle. In this event it is likely to be a requirement that the tablet is placed in the drum of the washing machine with the laundry and not in a dispenser drawer.

Many commercially important fabric softening agents are organic compounds containing quaternary nitrogen and at least one carbon chain of 6 to 30 carbon atoms, e.g. in an alkyl, alkenyl or aryl substituted alkyl or alkenyl group with at least six aliphatic carbon atoms.

Other suitable fabric softening agents are the analogous tertiary amines and imidazolines, other aliphatic alcohols, esters, amines or carboxylic acids incorporating a C8 to C30 alkyl, alkenyl or acyl group, including esters of sorbitan and esters of polyhydric alcohols, and mineral oils. Certain clays are important as fabric softening agents. Another class of materials used as fabric softening agents are hydrophobically modified cellulose ethers.

Some specific instances of fabric softening agents include:

1) Acyclic Quaternary Ammonium Compounds of the Formula (I)

(I)

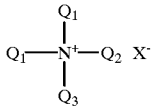

wherein each $Q_1$ is a hydrocarbyl group containing from 15 to 22 carbon atoms, $Q_2$ is a saturated alkyl or hydroxy alkyl group containing from 1 to 4 carbon atoms, $Q_3$ may be as defined for $Q_1$ or $Q^2$ or may be phenyl and $X^-$ is an anion preferably selected from halide, methyl sulphate and ethyl sulphate radicals.

Throughout this discussion of fabric softening agents, the expression hydrocarbyl group refers to alkyl or alkenyl groups optionally substituted or interrupted by functional groups such as —OH, —O—, CONH, —COO—, etc.

Representative examples of these quaternary softeners include ditallow dimethyl ammonium chloride; di(hydrogenated tallow)dimethyl ammonium chloride; di(coconut)dimethyl ammonium chloride; di(coconut) dimethyl ammonium methosulphate.

2) Ester Quaternary Ammonium Salts

A number of ester group containing quaternary ammonium salts, including those disclosed in EP 345842 A2 (Procter), EP 239910 (Procter) and U.S. Pat. No. 4,137,180 (Lever) are suitable for use in the tablets of the present invention. These materials can be represented by generic formulae (II) and (III) below.

(II)

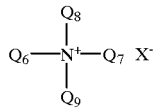

(III)

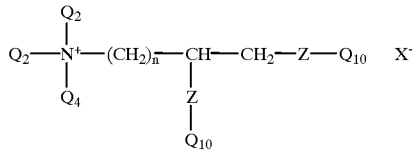

In formulae (II) and (III) each $Q_2$ is a saturated alkyl or hydroxy alkyl group containing from 1 to 4 carbon atoms;

$Q_4$ is as defined for $Q_2$ or may be phenyl;

$Q_6$ is a hydrocarbyl group (preferably alkyl) containing 1 to 4 carbon atoms;

$Q_{10}$ is a hydrocarbyl group containing from 12 to 22 carbon atoms;

$Q_7$ is $—CH_2—Y—Z—Q_{10}$ $Q_8$ is as defined for $Q_7$ or $Q_{10}$;

$Q_9$ is as defined for $Q_7$ or $Q_{10}$ or is an alkyl or hydroxyalkyl group of 1 to 4 carbon atoms or is phenyl;

Y is $—CH(OH)—CH_2—$ or is divalent alkylene of one to three carbon atoms;

Z is —O—C(O)—O, —C(O)—O or —O—C(O)— and $X^-$ is an anion.

Examples of suitable materials based on formula (II) are N,N-di(tallowyl-oxyethyl), N-methyl, N-hydroxyethyl ammonium chloride; N,N-ditallowyl-oxyethyl)-N,N-dimethyl ammonium chloride; N,N-di(2-tallowyloxy-2-oxo-ethyl)-N,N-dimethyl ammonium chloride; N,N-di(2-tallowyloxyethylcarbonyl oxyethyl)-N,N-dimethyl ammonium chloride; N-(2-tallowloxy-2-ethyl)-N-(2-tallowyl oxo-2-oxyethyl)-N,N-dimethyl ammonium chloride; N,N,N-tri(tallowyl-oxyethyl)-N-methyl ammonium chloride; N-(2-tallowyloxy-2-oxyethyl)-N-(tallowyl-N,N-dimethyl)-ammonium chloride. Tallowyl may be replaced with cocoyl, palmoyl, lauryl, oleyl, stearyl and palmityl groups. An illustrative example of a formula (III) material is 1,2-ditallowyloxy-3-trimethyl ammoniopropane chloride.

3) Quaternary Imidazolinium Salts

A further class of cationic softener materials is the imidazolinium salts of generic formula (IV).

(IV)

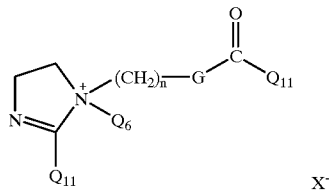

wherein $Q_{11}$ is a hydrocarbyl group containing from 6 to 24 carbon atoms, G is —N(H)—, or —O—, or —$NQ_2$—, n is an integer between 1 and 4, and $Q_2$ and $Q_6$ are as defined above.

Preferred imidazolinium salts include 1-methyl-1-(tallowylamido)ethyl-2-tallowyl-4,5dihydro imidazolinium methosulphate and 1-methyl-1-(palmitoylamido)ethyl-2-octadecyl-4,5-dihydroimidazolinium chloride. Other useful imidazolinium materials are 2-heptadecyl-1-methyl-1-(2stearylamido)ethyl imidazolinium chloride and 2-lauryl-1-hydroxyethyl-1-oleyl imidazolinium chloride. Also suitable are the imidazolinium fabric softening components of U.S. Pat. No. 4,127,489.

4) Primary, Secondary and Tertiary Amines

Primary secondary and tertiary amines of general formula (V) are useful as softening agents.

(V)

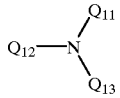

wherein $Q_{11}$ is a hydrocarbyl group containing from 6 to 24 carbon atoms, $Q_{12}$ is hydrogen or a hydrocarbyl group containing from 1 to 22 carbon atoms and $Q_{13}$ can be hydrogen or a hydrocarbyl group containing from 1 to 6 carbon atoms. Preferably amines are protonated with hydrochloric acid, orthophosphoric acid or citric acid or any other similar acids for use in cleaning compositions of the present invention. Specific examples of tertiary amines that are suitable for use in the tablets of the present invention are those disclosed in EP 213720 (Unilever).

5) Cellulase

British Patent Specification GB 1 368 599 (Unilever) discloses the use of cellulolytic enzymes, i.e. cellulases, as harshness reducing agents. It is thought that cellulose achieves its anti-harshening effect on, e.g. cotton, by cleaving the cellulosic fibrils which form on the cotton fibres during the normal washing process. This cleavage prevents the fibrils from bonding together and thereby introducing a degree of rigidity into the fabric.

It is preferred to use cellulases which have an optimum activity at alkaline pH values, such as those described in British Patent Specifications GB 2 075 028 A (Novo Industrie A/S), GB 2 095 275 A (Kao Soap Co Ltd) and GB 2 094 826 A (Kao Soap Co Ltd).

Examples of such alkaline cellulases are cellulases produced by a strain of Humicola insolens (*Humicola grisea* var. *thermoidea*), particularly the Humicola strain DSM 1800, cellulases produced by a fungus of Bacillus N or a cellulase 212-producing fungus belonging to the genus Aeromonas, and cellulase extracted from the hepatopancreas of a marine mollusc (*Dolabella auricula solander*).

The amount of cellulase in a tablet of the invention will, in general, be from 0.1 to 10% by weight. In terms of cellulase activity the use of cellulase in an amount corresponding to from 0.25 to 150 or higher regular $C_x$ units/gram of the detergent composition is within the preferred scope of the present invention. A most preferred range of cellulase activity, however, is from 0.5 to 25 regular $C_x$ units/gram of the detergent composition.

6) Clays

Certain clays with ion exchange properties are effective as fabric softeners. It is believed that clay materials achieve their softening benefit on, e.g. cotton, by coating the cotton fibrils with a layer of lubricating material. This coating lowers the friction between the fibrils and reduces their tendency to bond together.

Suitable clay materials are phyllosilicate clays with a 2:1 layer structure, which definition includes smectite clays such as pyrophyllite, montmorillonite, hectorite, saponite and vermiculite, and includes micas. Particularly suitable clay materials are the smectite clays described in U.S. Pat. No. 4,062,647 (Storm et al assigned to The Procter & Gamble Company). Other disclosures of suitable clay materials for fabric softening purposes include European patent specification EP 26528-A (Procter & Gamble Limited). U.S. Pat. No. 3,959,155 (Montgomery et al assigned to The Procter & Gamble Company), and U.S. Pat. No. 3,936,537 (Baskerville).

EP 177 165 (Unilever) discloses that clays can be used in combination with cellulase. Also suitable for use in the tablets of the present invention are the combinations of clays and tertiary amines which are disclosed in EP 011340 (The Procter & Gamble Company).

Particularly preferred clays have an ion exchange capacity of at least 50 meq/100 g of clay. The ion exchange capacity relates to the expandable properties of the clay and to the charge of the clay, and is conventionally measured by electrodialysis or by exchange with ammonium ion followed by titration.

The amount of fabric softening clay material in a tablet should be sufficient to provide the fabrics with a softening benefit. A preferred level is from 1 to 35% by weight of the tablet, most preferably from 1% or 4% to 15%, these percentages referring to the clay mineral per se. Levels of clay raw material higher than this may be necessary when the raw material is derived from a particularly impure source.

Other Fabric Conditioning Agents

Some fabric conditioning agents may be included in a region which disintegrates more rapidly than the remainder of the tablet.

Silicone oils (polysiloxanes) have been proposed as fabric conditioning agents, and more specifically polysiloxanes with amino alkyl side chains have been proposed. Discussions of these materials can be found in GB-A-1549180 where they are included in fabric softener formulations to assist ironing of the fabric and to inhibit wrinkling.

EP-A-150867 (Procter & Gamble) discloses the incorporation of amino alkyl polysiloxanes into particulate detergent compositions to enhance the softeners and handling of washed fabrics. Their use in particulate compositions is also disclosed in FR-A-2713237 (Rhone-Poulenc) which utilises them as fabric softeners. These materials may be mixed into nonionic detergent before that is incorporated into a particulate composition, as taught by EP-A-150867, or absorbed directly onto a particulate carrier, as taught by FR-A-271237, and mixed with the remainder of a particulate composition. The particulate composition can thereafter be compacted to form a region of a tablet in accordance with the present invention.

The amino alkyl polysiloxanes function as fibre lubricants. They are desirably incorporated into the more rapidly disintegrating region of a tablet, so as to deposit on fabric at an early stage of the washing cycle.

Another fabric conditioning agent which could be incorporated in a region of a tablet according to this invention is a curable amine functional silicone (amino alkyl polysiloxane) disclosed in U.S. Pat. No. 4,911,852 (Procter & Gamble) as an anti-wrinkle agent.

Other Ingredients

The detergent tablets of the invention may also contain one of the detergency enzymes well known in the art for their ability to degrade various soils and stains and so aid in their removal. Suitable enzymes include various proteases, cellulases, lipases, amylases, oxidases and mixtures thereof, which are designed to remove a variety of soils and stains from fabrics or from tableware during dishwashing. As mentioned earlier, cellulases have a fabric softening function also. Detergency enzymes are commonly employed in the form of particles or marumes, optionally with a protective coating, in amount of from about 0.01% often from 0.1% to about 3% by weight of the tablet. A total enzyme content may exceed 3% but is unlikely to exceed 5%. The amount of any one enzyme is likely to lie in a range from 0.01% to 3% by weight of the tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino)stilbene disulphonate; and Tinopal CBS is disodium 2,2'-bis-(phenylstyryl)disulphonate.

An antifoam material is advantageously included, especially if a detergent tablet is primarily intended for use in front-loading drum-type automatic washing machines. Antifoam materials in granular form are described in EP 266863A (Unilever). Such antifoam particles typically comprise a mixture of silicone oil, petroleum jelly, hydrophobic silica and alkyl phosphate so as antifoam active material, sorbed onto a porous absorbed water-soluble carbonate-based inorganic carrier material.

Further ingredients which can optionally be employed in fabric washing detergent tablet of the invention include anti-redeposition agents such so as sodium carboxymethylcellulose, straight-chain polyvinyl pyrrolidone (which can also act as a binder, as mentioned earlier) and the cellulose ethers such as methyl cellulose and ethyl hydroxyethyl cellulose, heavy metal sequestrants such as EDTA; perfumes; soil release polymers and colorants or coloured speckles.

Proportions and Tablet Types

A tablet of this invention intended for fabric washing will generally contain, overall,

- at least 5%, better at least 8%, up to not over 50%, possibly not over 30 or 40%, by weight of non-soap organic detergent which is preferably a combination of anionic and nonionic detergents;
- at least 15%, better at least 20 or 25%, up to 80%, possibly not over 70 or 60% by weight of one or more detergency builders which may be water-soluble, water-insoluble or a mixture of soluble and insoluble builders;
- optionally other ingredients which may amount to at least 10% by weight of the tablet.

The amount of anionic surfactant is likely to be from 5 to 50% by weight of the overall tablet composition while the amount of nonionic surfactant is likely to be from 2% to 40%, better from 4 or 5% up to 30% by weight of the overall tablet. Soap may be included in addition to non-soap anionic surfactant.

A tablet of this invention intended for machine dishwashing, will generally be formulated with a small percentage of nonionic surfactant present such so as 1 to 8% by weight, from 20 to 99% detergency builder, and possibly no anionic detergent at all.

The discrete regions of a tablet may have compositions which lie outside the stated ranges. However, the compositions of regions may well individually conform with the ranges indicated above for a complete tablet of the appropriate character, i.e. machine dishwashing or fabrics washing.

It is likely that each discrete region of a tablet will provide from 5% to 95% of the tablet weight, more preferably from 10 to 80% and likewise from 5 or 10% up to 80% or even 95% of the area of a tablet face.

A region such as a core which provides a first part of a tablet face adjoined or surrounded by a larger second part of the face, is likely to constitute from 10% or 15% up to 35% or 40% of the tablet weight and from 10% or 15% up to 35% or 40% of the area of the tablet face.

If a tablet contains peroxygen bleach, the amount of such bleach in the tablet is likely to be from 10% to 25% by weight of the whole tablet composition. Although peroxygen bleaches can be used without a bleach activator, the amount of bleach activator is likely to be from 1 to 10% by weight of the whole tablet; but if the activator is a transition metal catalyst then the amount present is likely to be from 0.01 to 5% by weight of the whole tablet.

Particle Size and Distribution

The discrete regions of a detergent tablet of this invention, are a matrix of compacted particles. Preferably the particulate mixture of particles, from which each tablet region is compacted, has an average particle size before compaction in the range from 200 to 2000 $\mu$m, more preferably from 250 to 1400 $\mu$m. Fine particles, smaller than 180 $\mu$m or 200 $\mu$m may be eliminated by sieving before tableting, if desired, although we have observed that this is not always essential.

While the starting particulate composition may in principle have any bulk density, the present invention is especially relevant to tablets made by compacting powders of relatively high bulk density, because of their greater tendency to exhibit disintegration and dispersion problems. Such tablets have the advantage that, as compared with a tablet derived from a low bulk density powder, a given dose of composition can be presented as a smaller tablet.

Thus the starting particulate composition may suitably have a bulk density of at least 400 g/liter, preferably at least 550 g/liter, and perhaps at least 600 g/liter.

Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), are inherently suitable for use in the present invention.

Porosity

The step of compacting the particles reduces the porosity of the composition. Porosity is conveniently expressed as the percentage of volume which is air.

The air content of a tablet or region of a tablet can be calculated from the volume and weight of the tablet or region, provided the air-free density of the solid content is known. The latter can be measured by compressing a sample of the material under vacuum with a very high applied force, then measuring the weight and volume of the resulting solid.

The percentage air content of a tablet or region of a tablet varies inversely with the pressure applied to compact the composition while the strength of the tablet or region varies with the pressure applied to bring about compaction. Thus the greater the compaction pressure, the stronger the tablet or region becomes but the smaller the air volume within.

The invention may be applied when compacting particulate detergent composition to give tablets with a wide range of porosities. Specifically included among possible porosities is a porosity of up to 38% air volume, e.g. from 10 or 15 better 25% up to 35% air by volume in the tablet.

Figure 1B:
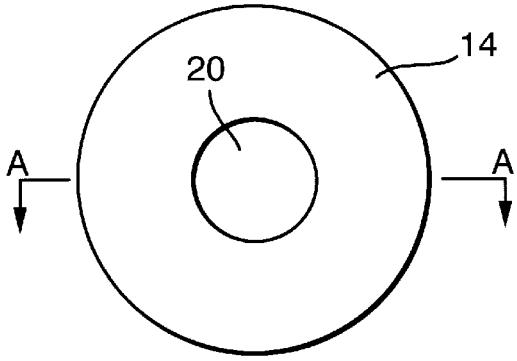
Figure 2:
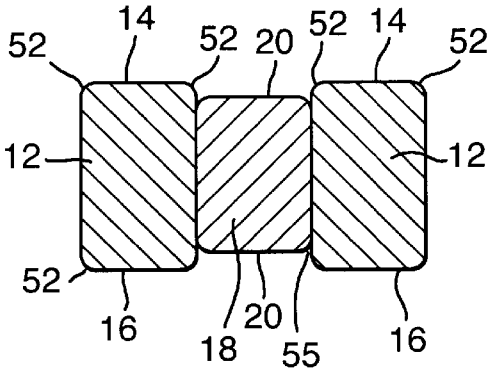

A number of embodiments of this invention will be described by way of example with reference to the accompanying drawings in which:

FIGS. 1*a* and 1*b* are perspective and face views of a tablet according to this invention, FIG. 2 is a section on the line AA of FIG. 1*b,*

Figure 8:
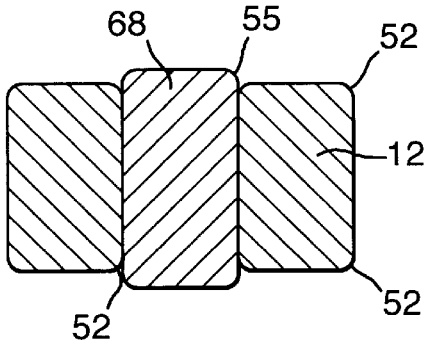
Figure 9:
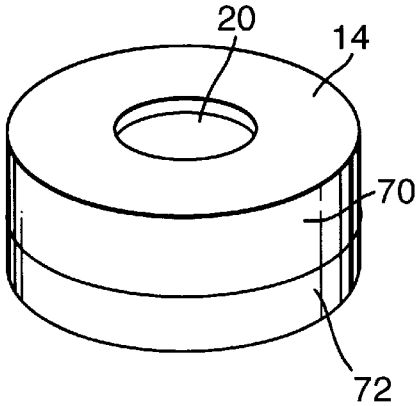
Figure 10:
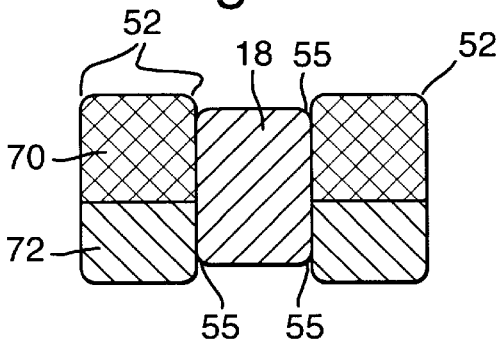
Figure 3A:
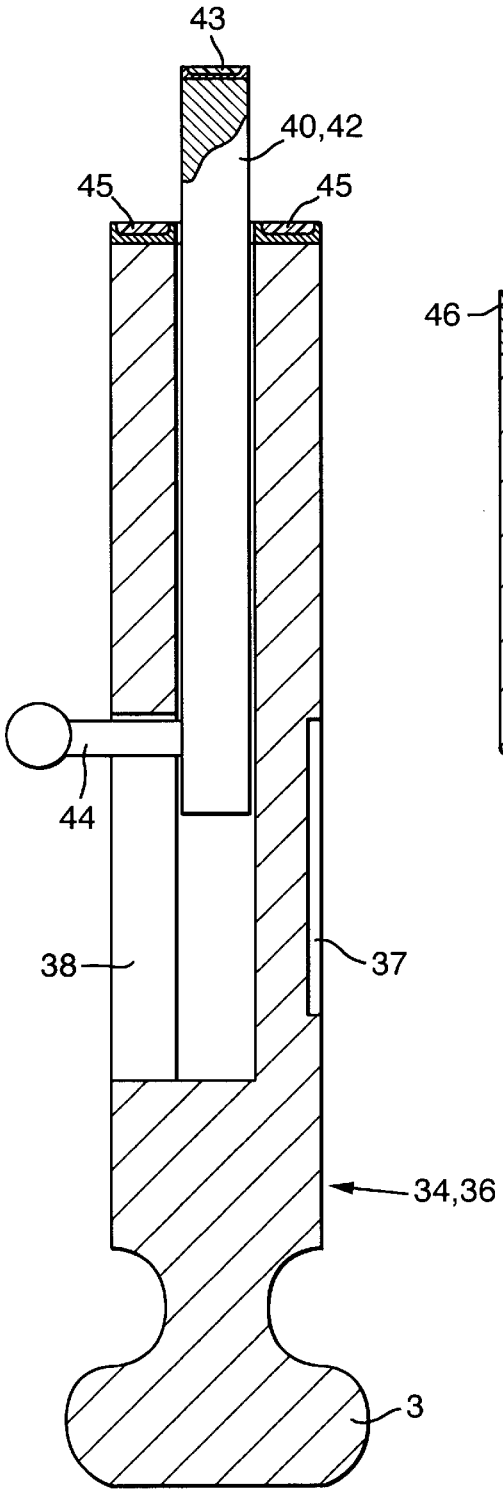
Figure 3B:
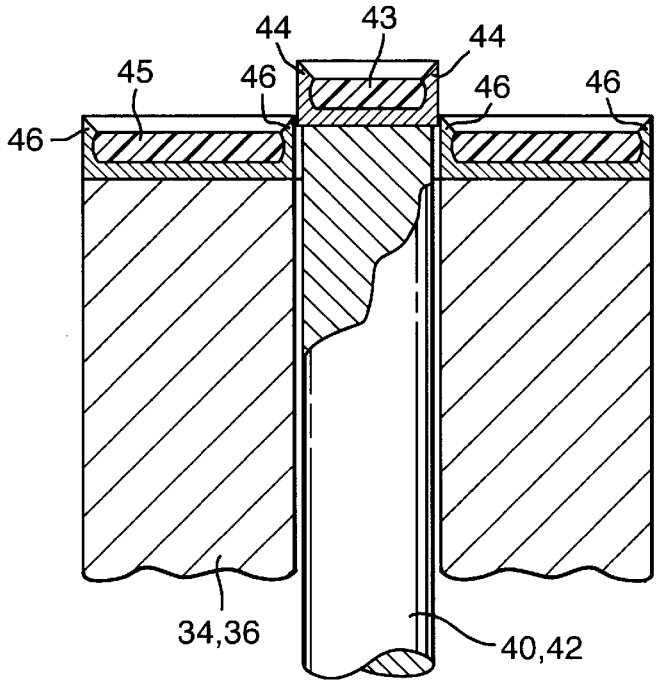
Figure 11:
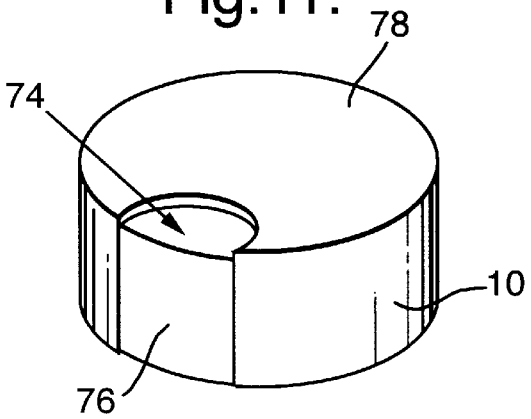
Figure 12:
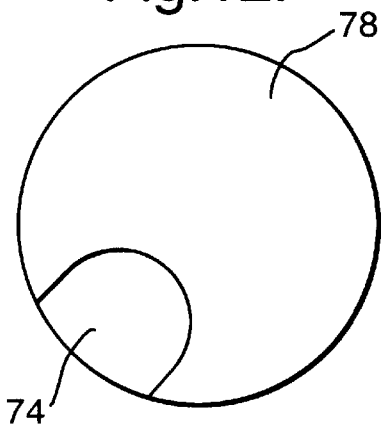
Figure 13:
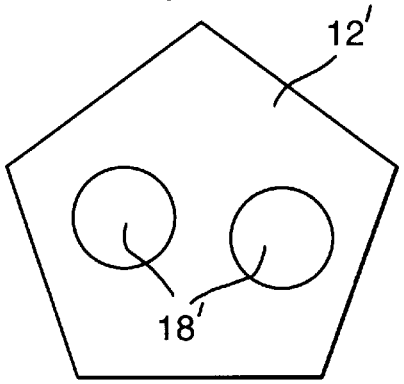

FIG. 3*a* is a sectional view showing a punch and plunger used in tablet manufacture, FIG. 3*b* is an enlarged sectional view showing the operative end parts of a punch and a plunger, FIG. 4 is a diagrammatic illustration of the manufacture of one region of the tablet shown in FIGS. 1 and 2, FIG. 5 diagrammatically illustrates subsequent stages in which a core region is added to the region found in FIG. 3, FIG. 6 shows a variation on FIG. 5, FIG. 7 shows another variation on FIG. 5, FIG. 8 is a sectional view analogous to FIG. 2, of the tablet made by the procedure in FIG. 7, FIGS. 9 and 10 are views, corresponding to FIGS. 1*b* and 2, showing a further form of tablet, FIGS. 11 and 12 are views corresponding to FIGS. 1*a* and 1*b* showing yet another form of tablet, and FIG. 13 is a face view of a tablet with multiple cores.

As shown by FIGS. 1 and 2, a tablet embodying the present invention has a generally cylindrical shape with a cylindrical peripheral wall 10. The tablet has an annular surrounding region 12 which provides the peripheral cylindrical surface 10 and annular parts 14,16 of the end faces of the tablet. Located centrally within this region is another discrete region in the form of a cylindrical core 18 which has a pair of end faces 20 recessed inwardly from the end faces 14,16 of the surrounding region.

Tablets as shown in FIGS. 1 and 2 can be made in accordance with the process of this invention using a modified form of rotary tabletting press. This is shown by FIGS. 3 to 5.

The tabletting press has a rotary table 30 defining a plurality of cavities 32 in which tablet stamping occurs. Associated with each cavity are upper and lower punches 34,36. These move around the table axis in unison with rotation of the table, but can be moved axially relative to the rotary table 30 and each other, so that they can be driven into the cavity in the table or withdrawn from it. Lower punches 36 have the same construction as upper punches 34.

As shown by FIG. 3*a*, each punch 34 or 36 is cylindrical and provided with an end piece 39 which is shaped to engage with a cam track (not shown) for moving the punch towards and away from the rotary table 30 as the table rotates. This is the same as a conventional arrangement for the stamping of homogenous tablets of a single composition using solid punches.

Each punch 34,36 has a central bore accommodating an axially moveable plunger 40,42. Attached to each plunger is an arm 44 projecting radially through a slot 38 in the cylindrical punch to engage another cam track (also not shown) which brings about axial motion of the plunger. Each punch 34,36 also has a keyway 37 into which engages a key (not shown) which serves to constrain the punch against unwanted rotation about its own axis i.e. rotation relative to the rotary table 30.

The end face of each plunger and punch, where the plunger and/or punch respectively contacts the detergent composition could be formed from the solid metal of the punch or plunger. Our published application WO 98/46719 teaches that adhesion of the detergent composition to a punch can be beneficially reduced by providing an elastomeric surface layer to contact the detergent composition. As seen best from FIG. 3*b*, the plunger has an elastomeric surface layer 43 retained by an undercut rim 44 around the operative end of the plunger while the punch has likewise an elastomeric surface layer 45 which is retained by undercut rims 46 around the inner and outer boundaries of the annular operative surface of the punch. These undercut rims 44,46 are best seen in FIG. 3*b*. They have been omitted, for clarity, from the smaller scale FIGS. 4 to 7 which will now be described.

FIGS. 4 and 5 show a succession of stages of rotation of the table 30 and the associated movements of the punches and plungers.

Figures 4A, 4B, 4C, 4D, 4E:
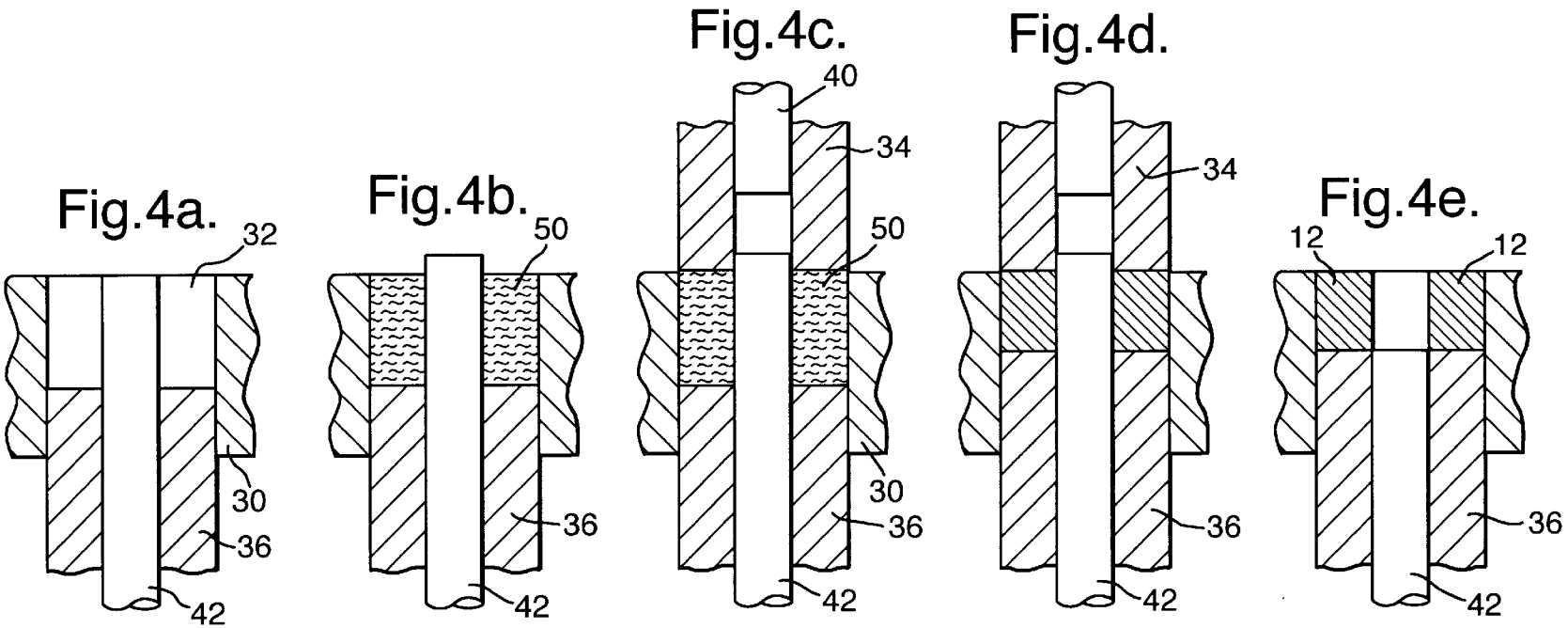

The sequence of operations starts with a lower punch 36 in the position shown at FIG. 4*a* while the associated upper punch 34 is raised out of the way. The plunger 42 in the lower punch 36 is raised to project through the cavity 32 of the rotary tablet. Thus the space around it is annular. As the table rotates, this annular space is filled as shown at FIG. 4*b* with a first detergent composition 50 for compaction and the plunger 42 is raised slightly. Next at FIG. 4*c* the upper punch 34 is brought down on top of the composition 50, after which, at FIG. 4*d* the lower punch 36 is urged upwardly, thus compacting the composition 50 around the raised plunger 42 of the lower punch into an annular region 12 of a tablet. The upper punch 34 is then raised out of the way and the plunger 42 is lowered as shown at FIG. 4*e*.

A detail which is omitted from FIG. 4 is shown in FIG. 2. When the rims 46 on the punches 34,36 contact the composition 50 as it is being compacted, they form indentations 52 encircling the inner and outer edges of the annular faces 14,16 of the region 12.

Figures 5A, 5B, 5C, 5D, 5E:
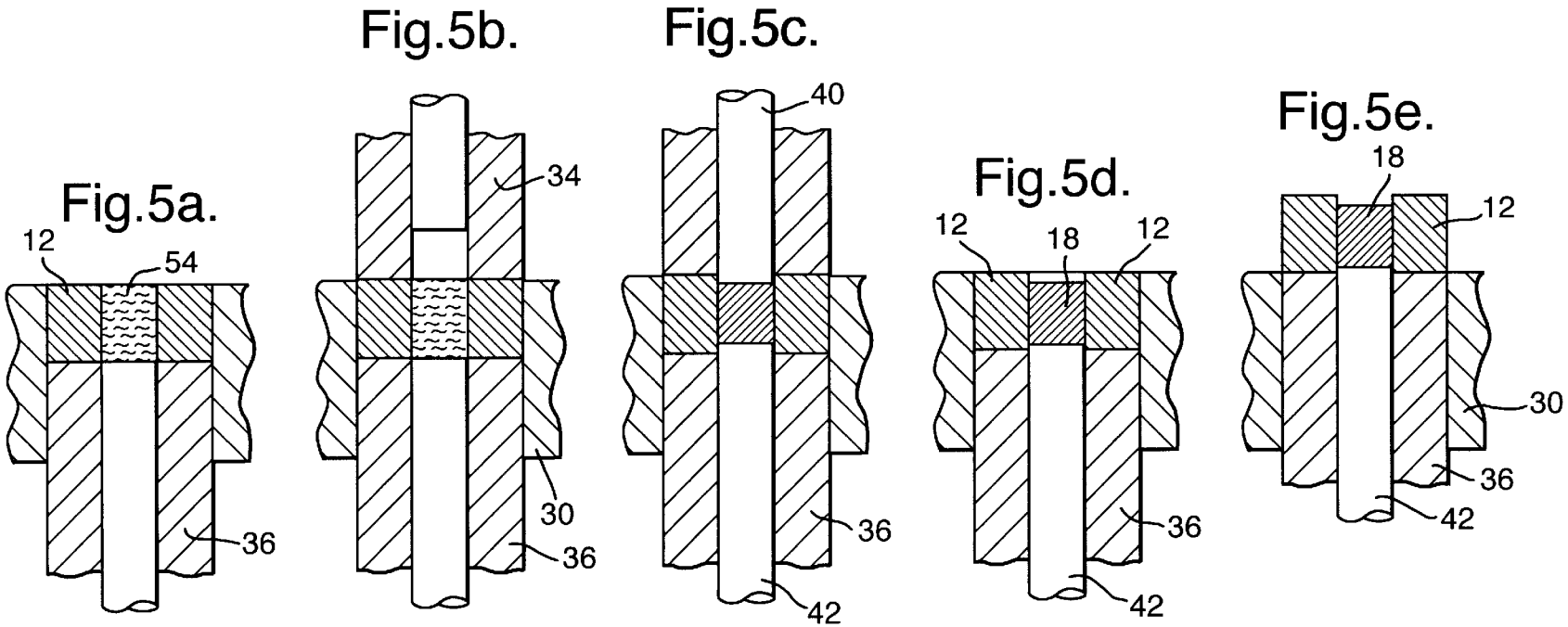

Subsequent steps take place further on in the rotation of the table 33. As shown at FIG. 5*a*, second composition 54 is introduced into the cavity above the plunger 42. Next at FIG. 5*b* the upper punch 34 is lowered onto the previously formed outer region 12 of the tablet but does not apply any substantial pressure to it. The upper and lower plungers 40,42 are urged towards each other as shown at FIG. 5*c* so that the particulate composition 54 is compacted between these plungers and is also forced radially outwardly into contact with the surrounding region 12 of the tablet.

As the rims 44 on the plungers 40,42 contact the composition 54 which is being compacted, they form indentations 55 encircling the faces 20 of the region 18.

In this way the tablet which is formed has the features shown by FIGS. 1 and 2 with the faces 20 of the central core 18 set inwardly from the outer faces 14, 16 of the surrounding region 12.

Finally the upper punch 34 is again raised as shown at FIG. 5*d* and the tablet is ejected from the cavity by raising the lower punch 36 and plunger 42 together, as shown at FIG. 5*e*. The lower punch is then lowered to the position shown by FIG. 4*a* for the cycle to be repeated.

Figure 6A:
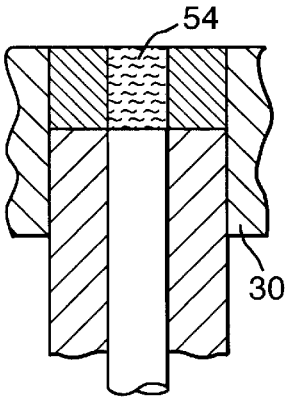
Figure 6B:
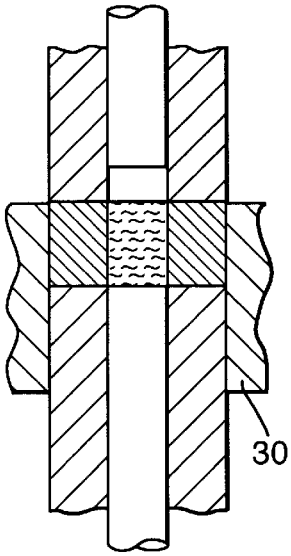
Figure 6C:
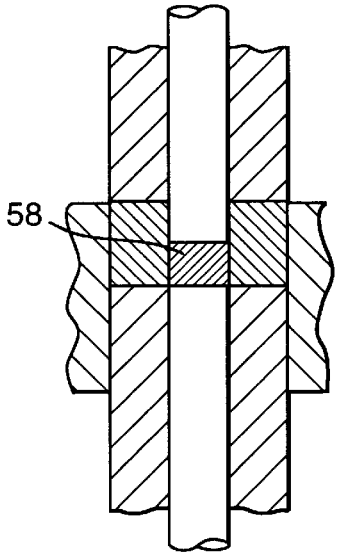
Figure 6D:
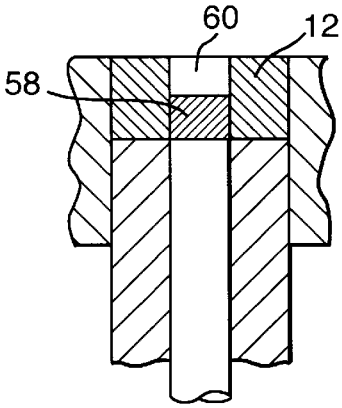
Figure 6E:
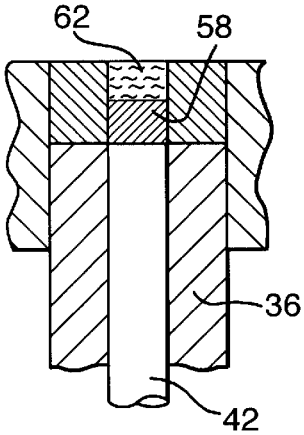
Figure 6F:
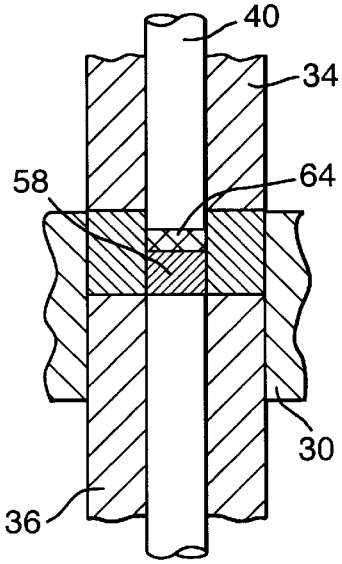

In the variant arrangement shown by FIG. 6, the composition 54 is compacted into a core region 58 by driving the plunger 40 downwardly while the plunger 42 does not more axially, as shown at FIG. 6*c*. The upper punch 34 is then raised out of the way, leaving a cavity 60 above the core region 58 as seen at FIG. 6*d*. As shown at FIG. 6*e* a further composition 62 is introduced into the cavity 60. It is compacted as shown at FIG. 6*f* to form a tablet with an outer region 12 surrounding a central core which has two layers 58,64. The punch 34 is raised and the tablet is ejected by raising the punch 36 and plunger 42 together (not shown).

FIG. 7 shows another variant arrangement leading to the production of a tablet having the form shown in cross-section in FIG. 8. As can be seen in FIG. 8, the tablet has an outer region 12 and an inner core region 68 but the core region 68 stands out from the end faces 14,16 of the first region 12.

Figure 7E:
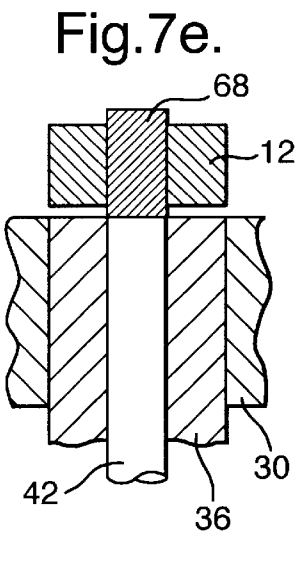
Figure 7D:
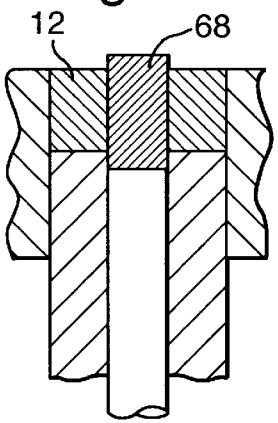
Figure 7C:
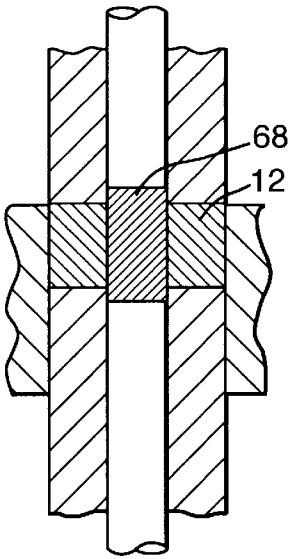
Figure 7B:
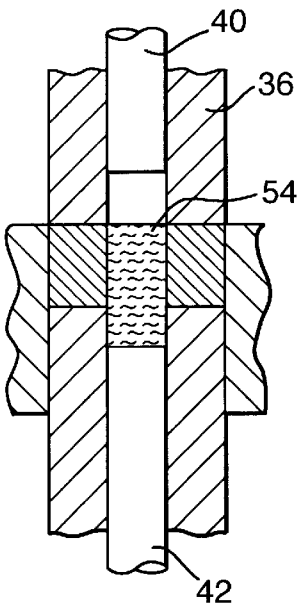
Figure 7A:
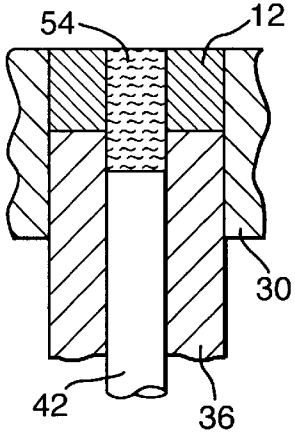

To make this tablet the outer region 12 is first made in accordance with the procedure illustrated by FIG. 4. Next, as shown by FIG. 7*a* the plunger 42 is lowered to below the upper surface of the punch 36. The second detergent composition 54 is filled into the cavity above the plunger 42 which is bounded partially by the upper end portion of the punch 36 and partially by the already formed first region 12. Next as shown at FIG. 7*b*, the upper punch 34 is placed on the already formed region 12 but without applying substantial pressure to it. As shown at FIG. 7*c* the plungers 40,42 are urged together compacting the detergent composition 54 so as to form the core region 68. When the upper punch 34 is raised out of the way as illustrated by FIG. 7*d* the compacted core region 68 stands above the upper surface of the rotary table 30. To eject this tablet from the cavity in the table the lower punch 36 is raised until it is level with the top of the table 30 and the plunger 42 within it is also raised slightly so that it too is level with the top of the table as seen at FIG. 7*e*.

FIG. 6 has already illustrated the manufacture of a tablet according to this invention in which the core region consists of two layers. FIGS. 9 and 10 illustrate a tablet according to this invention in which the core region 18 consists of a single material but this is surrounded by an annular outer portion which is subdivided into two layers 70,72. To manufacture this tablet the outer portion is first manufactured by a variant of the procedure shown in FIG. 4. The procedure begins with the lower punch 36 somewhat raised from the position illustrated in FIG. 4*a* so that the cavity 32 above it is shallower. The plunger 42 is raised level with the top of the rotary table 30 as in FIG. 4*a*. Composition for the layer 72 is filled into the cavity 32, lightly compacted between the punches and pushed downwards in the mould cavity 32 to create an annular cavity around the plunger 42 and above the compacted layer 72. This is filled with composition to form the upper layer 70 and then both the lower layer 72 and the upper layer 70 above it are together compacted between the punches 34,36, analogously to FIGS. 4*c* and 4*d*. After the two layer outer annular portion of the tablet has been formed in this way, the core 18 is formed within it by the procedure of FIG. 5.

FIGS. 11 and 12 illustrate a further variant of the invention in which the tablet is not symmetrical around its central axis. One region 74 of the tablet is positioned adjacent to the tablet periphery and indeed it forms part 76 of the cylindrical periphery of the tablet. It is surrounded by a second region 78 which is the remainder of the tablet and which provides the remainder of the cylindrical periphery 10 of the tablet. The region 78 provides the majority of the area of each end face of the tablet. The tablet is formed in a manner analogous to the procedures of FIGS. 4 and 5 but the punches do not completely encircle a cylindrical plunger. Instead each plunger is shaped to fit in a groove in the cylindrical outer surface of the plunger.

Tablets do not need to be cylindrical neither do core regions within them. Other shapes can be made using punches, plungers and mould cavities of appropriate shape.

FIG. 13 illustrates a five-sided tablet having two core regions 18' which are inset from the surrounding region 12' which is the remainder of the tablet. Such a tablet can be made by the procedure described, using five sided punches with two bores accommodating two plungers which are moved in unison.

EXAMPLE 1

Fabric washing tablets with the form generally illustrated by FIGS. 1 and 2 are prepared using compositions as set out in the following table. Composition A is used to make the core region 18 with a radius of 10 mm. Composition B is used to make the surrounding region. The overall tablet radius is 20 mm, so that compositions A and B are used in a volume ratio of approximately 1:3. Their weight ratio is also approximately 1:3. Tablet weight is approximately 40 g.

| | % by weight | |
|---|---|---|
| | A | B |
| Granulated Components | | |
| linear alkyl benzene sulphonate | 10.9 | 10.0 |
| coconut alcohol 3EO | 7.0 | 6.4 |
| coconut alcohol 6EO | 6.1 | 5.6 |
| zeolite A24 | 37.0 | 18.7 |
| soap | 4.0 | 3.7 |
| SCMC | 1.2 | 1.1 |
| fluorescer | 0.3 | 0.2 |
| water | 7.5 | 6.9 |
| Postdosed Components | | |
| PEG 1500 | 0.0 | 4.3 |
| sodium perborate tetrahydrate | 0.0 | 19.5 |
| TAED granule | 0.0 | 4.2 |
| protease | 3.5 | 0.0 |
| amylase | 2.0 | 0.0 |
| lipase | 1.9 | 0.0 |
| bentonite clay having a cation exchange capacity of 95 meq/100 g | 0.0 | 16.0 |
| antifoam | 3.4 | 3.4 |
| sodium citrate dihydrate | 15.2 | 0.0 |
| TOTAL | 100 | 100 |

Composition A contains enzymes and also sodium citrate dihydrate which promotes disintegration when the composition is added to water (as disclosed in EP-A-711827); composition B contains a fabric softening clay and bleach, but does not contain sodium citrate dihydrate, nor enzymes.

For each composition, the materials listed as "granulated components" are mixed in a Fukae (Trade Mark) FS-100 high speed mixer-granulator. The soap is prepared in situ by neutralisation of fatty acid. The mixture is granulated and densified to give a powder of bulk density greater than 750 g/liter and a mean particle size of approximately 650 $\mu$m. The powder is sieved to remove fine particles smaller than 180 $\mu$m and large particles exceeding 1700 $\mu$m. The remaining solids are then mixed with the powder in a rotary mixer, after which the PEG is sprayed on at about 80° C. with the powder at 35 to 40° C.

The core region 18 and the surrounding region 12 are each compacted with approximately equal pressures.

When the tablets are added to water the core 18 of composition A disintegrates first, because of the presence of sodium citrate dihydrate. Consequently, the enzymes are released into the wash liquor ahead of the bleach and fabric softening clay.

EXAMPLE 2

Fabric washing tablets are prepared from the two compositions set out in the following table:

| | % by weight | |
|---|---|---|
| | C | D |
| Granulated Components | | |
| coconut primary alkyl sulphate | 10.5 | 8.8 |
| coconut alcohol 3EO | 7.0 | 5.9 |
| coconut alcohol 6EO | 6.1 | 5.1 |
| zeolite A24 | 37.0 | 31.0 |
| soap | 4.0 | 3.3 |
| SCMC | 1.2 | 1.0 |
| fluorescer | 0.3 | 0.25 |
| Moisture | 6.0 | 5.0 |
| Postdosed Components | | |
| PEG 1500 | 4.0 | 4.0 |
| sodium percarbonate | 0.0 | 16.0 |
| TAED granule | 0.0 | 4.2 |
| protease | 2.5 | 0.0 |
| amylase | 1.5 | 0.0 |
| lipase | 1.5 | 0.0 |
| tallowyl dimethyl amine | 0.0 | 4.0 |
| antifoam | 3.4 | 1.45 |
| sodium citrate dihydrate | 15.0 | 10.0 |
| TOTAL | 100 | 100 |

As can be seen from the table, the compositions have different post-dosed components: composition C contains enzymes and also has more sodium citrate dihydrate which promotes disintegration when the composition is added to water, whereas composition D contains tertiary amine as a fabric softener and also bleach, but does not contain enzymes.

The two compositions are used to make tablets with the form shown in FIG. 8. Each tablet has a radius of 20.0 mm and a weight of about 40 grams. The core 68 has a radius of 8.0 mm and is made from composition C using a light compaction pressure so that it disintegrates within 2 minutes when the tablet is placed in water. The surrounding region 12 is compacted from composition D with a higher compaction pressure, leading to a surrounding region 12 which is mechanically stronger, but less porous. It disintegrates over a period of 8 minutes when the tablet is immersed in water.

EXAMPLE 3

Tablets without enzymes for use in fabric washing were made, starting with spray-dried base powder of the following compositions:

| Ingredient | Parts by weight |
|---|---|
| Sodium linear alkylbenzene sulphonate | 9.6 |
| $C_{13-15}$ fatty alcohol 7EO | 1.1 |
| $C_{13-15}$ fatty alcohol 3EO | 3.2 |
| Sodium tripolyphosphate* | 24.3 |
| Sodium silicate | 5.9 |
| Soap | 0.3 |
| Acrylate/maleate copolymer | 1.2 |
| Sodium sulphate, moisture and minor ingredients | balance to 55 |

*Added to the slurry as anhydrous sodium tripolyphosphate containing at least 70% phase II form.

Particulate compositions were made by mixing this powder with other ingredients as tabulated below. These included particles of sodium tripolyphosphate specified to contain 70% phase I form and contain 3.5% water of hydration (Rhodia-Phos HPA 3.5 available from Rhone-Poulenc).

The compositions contained the following percentages by weight:

| | % by weight | |
|---|---|---|
| Ingredient | E | E |
| Base powder | 58 | 45 |
| Sodium percarbonate granules | 0 | 18 |
| TAED granules | 0 | 3.6 |
| Anti-foam granules | 4.0 | 0 |
| Perfume, and other minor ingredients | 3.4 | 3.4 |
| Rhodiaphos HPA3.5 tripolyphosphate | 30 | 30 |
| Sodium carbonate | 4.6 | 0 |
| TOTAL | 100 | 100 |

Portions of each composition were made into tablets of weight 40 gm generally as shown in FIGS. 1 and 2. Composition F is used for the core and composition E for the surrounding region. The core radius is 12 mm and the tablet's overall radius is 20 mm.

The compaction pressure for the core is less than for the surrounding region, to accelerate dissolution of the core which is also more porous than the surrounding region. Because the bleach is confined to the core, it is less likely to contact the fibres before it dissolves.

EXAMPLE 4

Fabric washing tablets with the form generally illustrated by FIGS. 1 and 2 are prepared using compositions as set out in the following table. Composition G is used to make the core region 18 with a radius of 10 mm. Composition H is used to make the surrounding region. The overall tablet radius is 20 mm.

| | % by weight | |
|---|---|---|
| | G | H |
| Granulated Components | | |
| linear alkyl benzene sulphonate | 0 | 13.0 |
| coconut alcohol 3EO | 4.5 | 6.4 |
| coconut alcohol 6EO | 4.1 | 5.6 |
| zeolite A24 | 38.0 | 26.0 |
| soap | 4.0 | 3.7 |
| Sodium carboxy methyl cellulose (SCMC) | 1.2 | 1.1 |
| fluorescer | 0.3 | 0.2 |
| Moisture | 6.0 | 6.9 |
| Postdosed Components | | |
| PEG 1500 | 4.5 | 0.0 |
| sodium percarbonate | 0.0 | 19.5 |
| TAED granule | 0.0 | 4.2 |
| protease | 5.0 | 0.0 |
| amylase | 2.5 | 0.0 |
| lipase | 2.5 | 0.0 |
| antifoam | 3.4 | 3.4 |
| sodium citrate dihydrate | 10.0 | 0.0 |
| sodium acetate trihydrate | 14.0 | 10.0 |
| TOTAL | 100 | 100 |

Composition G contains enzymes and also sodium acetate trihydrate which promotes disintegration in water. It is free of anionic detergent. It is compacted to form the core 18 using a light compaction pressure such as 45 MPa so as to produce a porous core which dissolves within 3 minutes and serves as an integral pre-wash composition.

The surrounding region 12 is compacted with a much higher pressure, such as 20 MPa, so that it disintegrates slowly in a washing machine, e.g. over a period of 20 to 30 minutes. It is less porous but is mechanically strong and serves to protect the core during storage.

For use the tablet is placed in the drum of an automatic washing machine which is operated on a cycle providing for a pre-wash, to give a delay after water enters the machine, before the water is heated and the main wash begins.

EXAMPLE 5

Tablets for machine dishwashing are made from the following compositions:

| Ingredient | % by weight J | % by weight K |
|---|---|---|
| $C_{13-15}$ fatty alcohol 7EO | 2.0 | 2.0 |
| Sodium tripolyphosphate | 52.0 | 20.0 |
| Sodium silicate | 16.0 | 20.0 |
| Sodium carbonate | 16.0 | 25.0 |
| sodium perborate monohydrate | 0.0 | 18.0 |
| TAED granule | 0.0 | 5.0 |
| protease | 2.0 | 0.0 |
| amylase | 3.0 | 0.0 |
| Sodium sulphate, moisture and minor ingredients | balance to 100% | balance to 100% |

The tablets are made with the shape illustrated by FIG. 8 with a tablet weight of 30 gram.

The core 18, with a radius of 10 mm is made from composition J and compacted lightly so that in use it dissolves quickly and releases the enzymes into the wash liquor. The surrounding region 12 is compacted from composition K using greater pressure so as to produce a strong, hard surrounding region which is less porous and which protects the core until the time of use.

What is claimed is:

1. A detergent tablet of compacted particulate composition which has a pair of opposite faces spaced apart from each other and joined by a peripheral surface of the tablet, wherein the tablet has a first region which is a core and which provides a first part of a said face and a second region which provides an adjoining part of the face with a discontinuity at the junction of the said parts of the face and wherein the first part of the said face is inset relative to the adjacent part of that face.

2. A tablet according to claim 1 wherein the first region extends through the tablet so as to be exposed at both faces.

3. A tablet according to claim 1 wherein the first region contains bleach or bleach activator at a greater concentration than a surrounding region.

4. A tablet according to claim 1 wherein the said first part of a face of the tablet is between 10 and 35% of the area of the whole face.

5. A detergent tablet of compacted particulate composition which has a pair of opposite faces spaced apart from each other and joined by a peripheral surface of the tablet, wherein the tablet has a first region which provides a first part of a said face and a second region which provides an adjoining part of the face with a discontinuity at the junction of the said parts of the face and wherein the first part of the said face stands out relative to the adjacent part of that face and further wherein the first region extends through the tablet so as to be exposed at both faces.

6. A process for producing a detergent tablet of compacted particulate composition according to claim 1 or 2 with a pair of opposite faces spaced apart from each other and joined by a peripheral surface of the tablet, wherein the tablet is subdivided into at least two discrete regions which provides adjoining part of a said face, comprising steps of:

i) introducing a particulate composition into a mould cavity around a plunger which projects into or through the mould cavity, ii) driving at least one punch against the composition around the plunger in the cavity, so as to compact it, iii) withdrawing the plunger from within the compacted composition, iv) introducing a second particulate composition into the space vacated by the plunger, and iv) urging at least one plunger against the composition introduced into this space, so as to compact it.

7. A process according to claim 6 wherein a rotary table defines a plurality of mould cavities and a pair of punches are associated with each cavity, each punch having a plunger which is at least partially surrounded by the punch and is movable axially relative to the punch.

* * * * *